US005469912A

United States Patent [19]

McAuliffe

[11] Patent Number: 5,469,912

[45] Date of Patent: Nov. 28, 1995

[54] PROCESS FOR PRODUCING ALUMINUM ALLOY SHEET PRODUCT

[75] Inventor: Donald C. McAuliffe, Golden, Colo.

[73] Assignee: Golden Aluminum Company, Golden, Colo.

[21] Appl. No.: 20,677

[22] Filed: Feb. 22, 1993

[51] Int. Cl.[6] ..... B22D 11/12; C22F 1/047

[52] U.S. Cl. ..... 164/476; 148/551; 148/692; 164/477; 164/479

[58] Field of Search ..... 164/430, 476–477, 164/479, 459; 420/542; 148/551, 692

[56] References Cited

U.S. PATENT DOCUMENTS

| | | | |
|---|---|---|---|
| 4,238,248 | 12/1980 | Gyöngyös et al. | 148/2 |
| 4,260,419 | 4/1981 | Robertson | 75/142 |
| 4,284,437 | 8/1981 | Baba et al. | 148/692 |
| 4,498,823 | 2/1985 | Bowman et al. | 164/477 |
| 4,664,175 | 5/1987 | Tanagimoto et al. | 164/455 |
| 5,062,901 | 11/1991 | Tanaka et al. | 148/692 |
| 5,110,545 | 5/1992 | McAuliffe et al. | 420/534 |
| 5,122,196 | 6/1992 | Fernandez | 148/692 |
| 5,197,536 | 3/1993 | Hanneman | 164/479 |

FOREIGN PATENT DOCUMENTS

| | | | |
|---|---|---|---|
| 0506100 | 9/1992 | European Pat. Off. | 148/692 |
| 1261466 | 11/1986 | Japan | 148/692 |
| 3293144 | 11/1988 | Japan | 148/692 |

OTHER PUBLICATIONS

Metals Handbook, Ninth Ed., vol. 4, p. 707, American Society of Metals, 1981.

*Primary Examiner*—J. Reed Batten, Jr.
*Attorney, Agent, or Firm*—Sheridan Ross & McIntosh

[57] ABSTRACT

An aluminum alloy is formed by continuously casting an aluminum alloy having a magnesium concentration of at least about 4.7 percent. Controlled forming and annealing steps in conjunction with the alloy form an aluminum sheet product that is useful for forming beverage container ends and tabs.

16 Claims, No Drawings

PROCESS FOR PRODUCING ALUMINUM ALLOY SHEET PRODUCT

BACKGROUND OF THE INVENTION

1. Field of the Invention

The present invention relates to a process for producing an aluminum alloy sheet product. More particularly, the present invention relates to a continuous casting process for producing an aluminum alloy sheet product that is suitable for beverage container end stock.

2. Description of Related Art

Aluminum alloy sheet stock with a relatively high magnesium content, such as AA 5082 or AA 5182 alloy sheet stock, is used to form ends for carbonated beverage containers. The ends must have a sufficient strength since a beverage container should be able to withstand an internal pressure of at least about 60 pounds if it is to contain unpasteurized beer and at least about 90 pounds if it is to contain pasteurized beer, soda pop, or any beverage having similarly high carbonation levels.

Aluminum alloy sheet is typically produced by direct chill casting of a molten aluminum alloy into an ingot which is then rolled into a strip. Alternatively, aluminum alloy sheet may be produced by a continuous strip casting process. An apparatus for continuous strip casting using a block caster is described in U.S. Pat. Nos. 3,709,281, 3,744,545, 3,747,666, 3,759,313 and 3,774,670.

In a block casting process, molten aluminum alloy is injected through a nozzle, or distributor tip, into a cavity formed between two sets of opposed chilled blocks that are continuously moving in a direction away from the distributor tip. While in the cavity, the alloy cools and solidifies to form an aluminum sheet. The aluminum sheet then exits the block caster and passes between rollers to further reduce the thickness of the strip. This is typically referred to as hot rolling.

As the continuous strip comes out of the hot rolling step, it is coiled and allowed to cool. The coil is then cold rolled to further reduce the thickness of the strip. Often, the strip will be cold rolled in several passes with an annealing (heat treatment) step between the cold rolling passes.

The continuous strip casting process using a block caster has been shown to be effective for producing aluminum alloy sheet from low magnesium alloys, for example, alloys having a magnesium content of less than about 4 percent. As used throughout this specification, including the claims, all percentages refer to weight percent, unless otherwise noted.

For example, U.S. Pat. No. 4,260,419 by Robertson discloses the use of a continuous strip casting process to cast an aluminum alloy having from about 1.3 percent to about 2.5 percent magnesium and from about 0.4 percent to about 1.0 percent manganese. U.S. Pat. No. 5,106,429 by McAuliffe et al. discloses a process for continuously casting an aluminum alloy sheet comprising from about 2 percent to about 2.8 percent magnesium and from about 0.9 percent to about 1.6 percent manganese. However, it is not believed that is has heretofore been possible to continuously cast an aluminum alloy sheet having significantly higher magnesium contents, such as the high magnesium aluminum alloys used for beverage container ends.

Since continuous casting using a block caster is an economical method for the production of aluminum alloy sheet, it would be useful to provide a continuous casting process for the fabrication of an aluminum alloy sheet product having high levels of magnesium which can be used for container end stock.

SUMMARY OF THE INVENTION

According to the present invention, a process for producing an aluminum alloy sheet is provided. The process includes the step of forming an aluminum alloy melt having from about 4.7 percent to about 5.4 percent magnesium and from about 0.2 percent to about 0.5 percent manganese. The aluminum alloy melt is cast in a block casting apparatus to form a cast strip which is then hot rolled to reduce the thickness of the cast strip by at least about 65 percent. The hot-rolled strip is annealed and then cold rolled to further reduce the thickness of the strip. After a first cold-rolling step, the cold-rolled strip is annealed and then further cold rolled to reduce the thickness.

In a particularly preferred embodiment, the aluminum alloy includes from about 5.0 percent to about 5.2 percent magnesium and most preferably includes about 5.1 percent magnesium. Further, it is preferable that the aluminum alloy melt include from about 0.3 percent to about 0.4 percent manganese. The alloy can also include up to about 0.35 percent iron, up to about 0.25 percent zinc, up to about 0.20 percent silicon, up to about 0.15 percent copper, up to about 0.10 percent chromium and up to about 0.10 titanium.

DESCRIPTION OF THE INVENTION

In accordance with the present invention, a process for producing an aluminum alloy sheet product is provided. The aluminum alloy sheet product produced according to the present invention is particularly useful for the formation of ends for beverage containers, particularly for use with beverages that have a high level of carbonation or beverages that are heat pasteurized. The aluminum alloy sheet can also be useful for forming the tabs used to open such beverage containers.

According to the present invention, the aluminum alloy sheet product is produced using a continuous casting apparatus and it is preferable to utilize a block casting apparatus. The block casting apparatus can be similar to the type disclosed in U.S. Pat. Nos. 3,709,281, 3,744,545, 3,747,666, 3,759,313 and 3,774,670, which are all incorporated herein by reference in their entirety.

The aluminum alloy for use in the present invention has a magnesium content of at least about 4.7 percent and preferably from about 4.7 percent to about 5.4 percent. It is particularly advantageous to utilize an alloy having from about 5.0 percent to about 5.2 percent magnesium and in a most preferred embodiment, the aluminum alloy includes about 5.1 percent magnesium. This level of magnesium is significantly higher than the 4.5 percent magnesium content that is typically used for beverage container end stock. It is believed that higher magnesium contents have not heretofore been utilized in conventional casting processes since the resulting aluminum alloy sheet would be too strong to be useful in typical forming operations. It has unexpectedly been found that higher magnesium content alloys are necessary when using a continuous casting process.

The manganese content can be from about 0.2 percent to about 0.5 percent, but it is preferred that the manganese content be from about 0.3 percent to about 0.4 percent. It is believed that the quality of aluminum alloy sheet produced according to the present invention is more sensitive to the manganese content than conventionally produced sheet due to the directionality of the grain structure of a continuously cast sheet. A manganese content outside of the preferred range may result in tears, cracks or other defects in the cast aluminum alloy sheet.

Other elements in the aluminum alloy sheet can include up to about 0.35 percent iron, up to about 0.25 percent zinc, up to about 0.20 percent silicon, up to about 0.15 percent copper, up to about 0.10 percent chromium and up to about 0.10 percent titanium. If elements other than those listed are present, they preferably constitute less than about 0.05 percent of the alloy individually and less than about 0.15 percent total.

According to the present invention, an aluminum alloy sheet product is formed in a continuous casting process from the above-described aluminum alloy composition. It is most preferred to use a continuous block casting apparatus. In this embodiment, the alloy melt is cast in a casting cavity formed by opposite pairs of traveling blocks. The strip of aluminum sheet cools as it travels through the block caster and solidifies within the chilling blocks until the strip exits the casting cavity where the chilling blocks separate from the cast strip and travel to a cooler, where the chilling blocks are cooled. The rate of cooling as the cast strip passes through the casting cavity of the block casting apparatus can be controlled by adjusting various process and product parameters. These parameters can include the composition of the material being cast, the strip thickness of the cast, the chill block material, the length of the casting cavity, the casting speed and the efficiency of the block cooling system.

It is preferred that the aluminum alloy be cast as thin as possible. This advantageously minimizes the amount of subsequent working of the strip necessary to reduce the strip thickness. Normally, a limiting factor in obtaining minimum strip thickness is the size of the distributor tip of the caster. The distributor tip is the nozzle that introduces the molten alloy into the block casting cavity. In a preferred embodiment of the present invention, the strip is cast at a thickness of from about 0.6 inch to about 0.8 inch ( 15.2 mm to 20 mm). For example, the distributor tip can have a thickness of about 19.6 mm (0.77 inch). However, it is contemplated that thinner strip can also be cast.

The cast strip normally exits the block casting apparatus at a temperature in the range of from about 850° F. to about 1100° F. (454° C. to about 593° C.).

Upon exiting the caster, the cast strip is then subjected to a hot rolling operation in a hot mill. The cast strip preferably enters the hot mill at a temperature in the range of from about 880° F. to about 1000° F. (471° C. to about 538° C.) more preferably in the range of from about 900° F. to about 975° F. (482° C. to about 524° C.). The hot mill rollers reduce the thickness of the strip, preferably by at least about 65 percent and more preferably by at least about 80 percent.

The hot rolled strip can be held at the hot mill exit temperature for a period of time, coiled and then annealed. The coiled strip is annealed for about 170 minutes, preferably at a temperature of from about 720° F. to about 730° F. (382° C. to about 388° C.). To maintain such an annealing temperature, the air temperature surrounding the coil can be from about 890° F. to about 905° F. (479° C. to 485° C.). The coil is then allowed to cool to room temperature.

After the coil has cooled to ambient temperature, it is then cold rolled in a first cold rolling stage to reduce the gauge by at least about 45 percent. In one embodiment, the first cold rolling stage includes two cold roll passes wherein the sheet is reduced in the first pass by, for example, about 28 percent and then the sheet is reduced in the second pass by, for example, about 33 percent for a total reduction of about 52 percent.

Following the first cold rolling stage, the strip is preferably annealed for about three hours at a temperature of from about 700° F. to about 800° F. (371° C. to 427° C.), more preferably from about 720° F. to about 730° F. (382° C. to 388° C.).

After the cold rolled and annealed strip is cooled to ambient temperature, it is subjected to a second cold rolling stage in which the thickness of the sheet is further reduced. The thickness is preferably reduced in the second cold rolling stage by from about 65 percent to about 70 percent. The total cold roll reduction, including both the first stage and second stage, is preferably from about 75 percent to about 85 percent.

When the aluminum alloy sheet stock is to be used for the production of tabs for beverage containers, an additional stabilizing annealing step has been found to be particularly useful. For example, the sheet stock can be annealed in air at a temperature of from about 295° F. to about 305° F. for a period of about 3 hours. This stabilizing anneal will increase the formability of the aluminum alloy sheet product so that tabs and other such items can be formed from the aluminum alloy sheet.

Aluminum alloy sheet formed according to the present invention preferably has a yield strength of at least about 48 ksi. The earing percentage, measured at 45° to the rolling direction, is preferably less than about 3 percent and the sheet preferably has an elongation of at least about 6 percent. The aluminum alloy sheet stock thus produced is useful for forming beverage container ends. Additional uses can include tab stock, automotive sheet and food can stock.

EXAMPLE

An aluminum alloy melt is formed having about 5.1 percent magnesium and about 0.35 percent manganese. The composition can also include, iron, zinc, silicon, cooper, chrome and titanium.

The aluminum alloy composition is cast through a distributor tip having a tip thickness of about 19.6 mm. The alloy is cast through the tip and is solidified and cooled in a block casting apparatus. Upon exiting the block casting apparatus, the cast strip has a thickness of about 0.775 inches.

The cast strip is then hot milled. The hot mill reduces the strip thickness by about 84 percent to a thickness of about 0.125 inch. The temperature of the strip exiting the hot mill is about 950° F.

After hot milling, the strip is annealed at a temperature of about 725° F. for 170 minutes with a 1.0 percent oxygen purge. After the coil cools to ambient temperature, it is then cold rolled in a first cold roll pass to reduce the thickness to about 0.090 inch and is then further cold rolled in a second cold roll pass to reduce the thickness to about 0.060 inch.

The strip is then annealed at a temperature of about 725° F. for about 180 minutes under a 0.5 percent oxygen purge. The strip is then put through a second cold roll stage wherein the thickness of the strip is reduced to about 0.020 inch, for a total cold roll reduction of about 84 percent. If desired, the strip can be further reduced to meet customer specifications. The strip has a yield strength of about 48 ksi, a 45° earing percentage of about 3 percent and an elongation of about 6 percent.

While various embodiments of the present invention have been described in detail, it is apparent that modifications and adaptations of those embodiments will occur to those skilled in the art. It is to be expressly understood that such modifications and adaptations are within the spirit and scope of the present invention.

What is claimed is:

1. A process for producing an aluminum alloy sheet, comprising the steps of:

(a) forming an aluminum alloy melt comprising from about 4.7 percent to about 5.4 percent magnesium and from about 0.2 percent to about 0.5 percent manganese;

(b) casting said aluminum alloy melt in a block casting apparatus to form a cast strip;

(c) hot rolling said cast strip to reduce the thickness of said cast strip by at least about 65 percent and form a hot rolled strip;

(d) annealing said hot rolled strip at a temperature of from about 720° F. to about 730° F. to form an annealed strip;

(e) cold rolling said annealed strip to further reduce said thickness and form a cold rolled strip;

(f) annealing said cold rolled strip at a temperature of from about 700° F. to about 800° F. to form a second annealed strip; and (g) cold rolling said second annealed strip to further reduce said thickness.

2. A process as recited in claim 1, wherein said aluminum alloy melt comprises from about 5.0 percent to about 5.2 percent magnesium.

3. A process as recited in claim 1, wherein said aluminum alloy melt comprises about 5.1 percent magnesium.

4. A process as recited in claim 1, wherein said aluminum alloy melt comprises from about 0.3 percent to about 0.4 percent manganese.

5. A process as recited in claim 1, wherein said aluminum alloy melt further comprises:

(i) up to about 0.35 percent iron;

(ii) up to about 0.25 percent zinc;

(iii) up to about 0.20 percent silicon;

(iv) up to about 0.15 percent copper;

(v) up to about 0.10 percent chromium; and (vi) up to about 0.10 percent titanium.

6. A process as recited in claim 1, wherein said cast strip exits said block casting apparatus at a temperature in the range of from about 950° F. to about 970° F.

7. A process as recited in claim 1, further comprising the step of:

(h) annealing said cold rolled second annealed strip at a temperature of from about 290° F. to about 305° F. to stabilize and increase the formability of said strip.

8. A process as recited in claim 1, wherein said hot rolling step reduces the thickness of said cast strip by at least about 80 percent.

9. A process as recited in claim 1, wherein said step of annealing said cold rolled strip is done at a temperature of from about 720° F. to about 730° F. for about 3 hours.

10. A process as recited in claim 1, wherein said cold rolling steps reduce the thickness of said cast strip by from about 75 percent to about 85 percent.

11. A process as recited in claim 1, wherein said first cold rolling step comprises two cold roll passes.

12. A process as recited in claim 1, wherein said first cold rolling step reduces the thickness of said annealed strip by at least about 45 percent.

13. A process for producing aluminum alloy sheet, comprising the steps of:

(a) forming an aluminum alloy melt comprising from about 5.0% to about 5.2% magnesium and from about 0.2% to about 0.5% manganese;

(b) casting said aluminum alloy melt in a block casting apparatus to form a cast strip;

(c) hot rolling said cast strip to reduce the thickness of said cast strip by at least about 65% and form a hot rolled strip;

(d) annealing said hot form strip to rolled an annealed strip;

(e) cold rolling said annealed strip to further reduce said thickness and form a cold rolled strip;

(f) annealing said cold rolled strip at a temperature of from about 700° F. to about 800° F. to form a second annealed strip; and (g) cold rolling said second annealed strip to further reduce said thickness.

14. A process as recited in claim 13, wherein said aluminum alloy melt comprises about 5.1% magnesium.

15. A process as recited in claim 13, wherein said aluminum alloy melt comprises from about 0.3% to about 0.4% manganese.

16. A process as recited in claim 13, wherein said aluminum alloy sheet has a yield strength of at least 48 ksi.

* * * * *